United States Patent [19]

Salomon

[11] 4,156,534

[45] May 29, 1979

[54] SAFETY BINDINGS FOR SKIS

[75] Inventor: Georges P. J. Salomon, Annecy, France

[73] Assignee: S.A. Establissements Francois Salomon & Fils, Annecy, France

[21] Appl. No.: 824,978

[22] Filed: Aug. 15, 1977

[30] Foreign Application Priority Data

Sep. 2, 1976 [FR] France ..... 76 26479

[51] Int. Cl.[2] ..... A63C 9/08

[52] U.S. Cl. ..... 280/612

[58] Field of Search ..... 280/612

[56] References Cited

U.S. PATENT DOCUMENTS 3,762,735 10/1973 Smolka ..... 280/612

3,892,980 7/1975 Anderson ..... 280/612 X 3,907,316 9/1975 Marker ..... 280/612

*Primary Examiner*—Joseph F. Peters, Jr.

*Assistant Examiner*—Milton L. Smith

*Attorney, Agent, or Firm*—Haseltine, Lake & Waters

[57] ABSTRACT

A safety binding for skis incorporates a device for adjusting the binding employing an electrical circuit assembly for detecting the stress exerted during skiing, or values representative of this stress, enabling alteration of the adjustment of the binding dependent upon the result of the detection.

The adjusting device is applicable to all types of safety bindings, abutments, heel members, bindings comprising plates or boots, and to all mechanical and/or electrical safety bindings.

6 Claims, 8 Drawing Figures

$V_s$
a
$h'_1$
$h'_2$
$h'_1$
$h'_2$
b
29
c
62
$V'_R$
d
38
$V_A$
$V_B$
e
67
f
68
g

SAFETY BINDINGS FOR SKIS

BACKGROUND OF INVENTION

The present invention relates to a safety binding for skis and more particularly a device for adjusting a binding of this type.

Current safety bindings for skis comprise an adjustable mechanism intended to release the binding in order to free the skier's boot when the skier's leg is in danger. The adjustment defining the release force is generally made by the skier himself or the person selling the binding, either without precise data, or depending on certain parameters such as the weight of the skier, the diameter of the head of his tibia, his skiing ability etc. In fact, it is necessary to take into account several parameters at the same time, in order to define an adjustment allowing good manoeuvrability whilst skiing in safety. The ideal is to adjust the binding to the lowest level facilitating sufficient manoeuvrability when skiing, while not causing inopportune release. At the present time, the skier has no means enabling him to make such an optimum adjustment.

SUMMARY OF INVENTION

The present invention makes it possible to resolve this drawback by very simple means.

To this end, this safety binding for skis is characterised in that it comprises means for detecting stresses exerted at the time of skiing, or values representative of these stresses and for making it possible to alter the adjustment of the binding depending on the result of the detection.

According to a first embodiment of the invention, the value of the maximum stress is displayed or recorded and this display or recording is used to manually alter the adjustment.

According to one variation of the invention, the alteration of the adjustment is made automatically depending on the stresses exerted at the time of skiing.

The invention thus offers the advantage that it makes it possible to obtain an optimum adjustment, under all conditions, depending on the level of stresses exerted during skiing. It is thus possible to obtain, at any time, a minimum adjustment of the release for reliable skiing manoeuvrability.

Various embodiments of the present invention will be described hereafter, as non-limiting examples, with reference to the accompanying drawings in which:

In the Drawings

DESCRIPTION OF INVENTION

Figure 1:
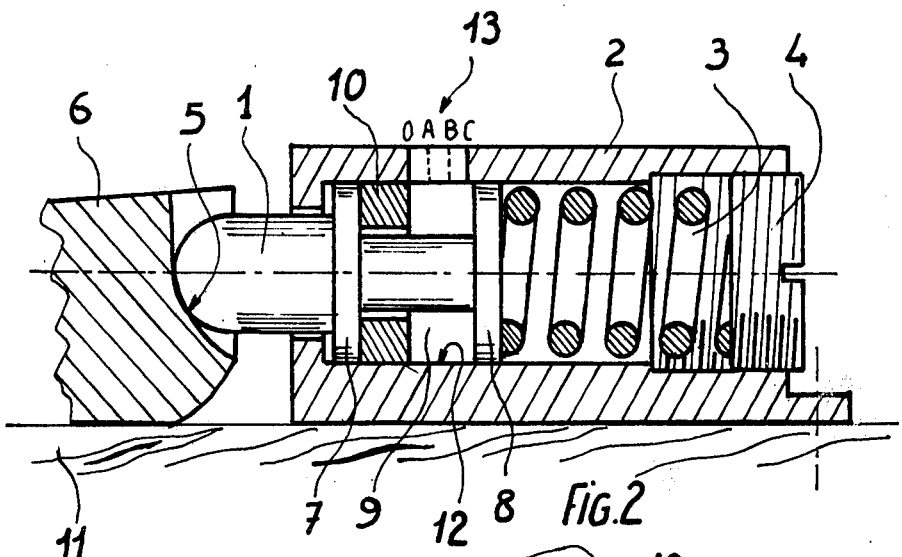
FIG. 1 is an axial sectional view of a safety binding provided with means for displaying the maximum stress, during skiing, these means being shown in the position which they occupy before the stress has been applied.

The safety binding illustrated in FIG. 1 comprises a body 2 fixed to a ski 1 and mounted to slide in the bore 12 in which a piston 1 is axially biased by a spring 3. This spring is supported at one end against a front side of the piston 1 and at the other end against an adjusting plug 4 which is screwed into a tapped hole provided at the end of the bore 12 of the body 2 in which the piston 1 slides.

The piston 1, which projects towards the outside through the base of the body 2, co-operates with a release ramp 5 of a plate 6 to which the ski boot is fixed. The safety release of the binding takes place by releasing the plate 6 against the action of the piston 1 pushed against the ramp 5 by the spring 3 adjustment of the tension is made possible by virtue of ramp 5.

The piston 2 comprises two cylindrical collars 7 and 8 which are guided longitudinally in the body 2. These two cylindrical collars 7 and 8 thus leave a free housing 9 therebetween, in which a display ring 10 is placed. This ring is resilient and slides with friction in the bore 12 of the body. However, it is mounted with a certain degree of freedom on the axis of the piston 1 between the two collars 7 and 8.

Figure 3:
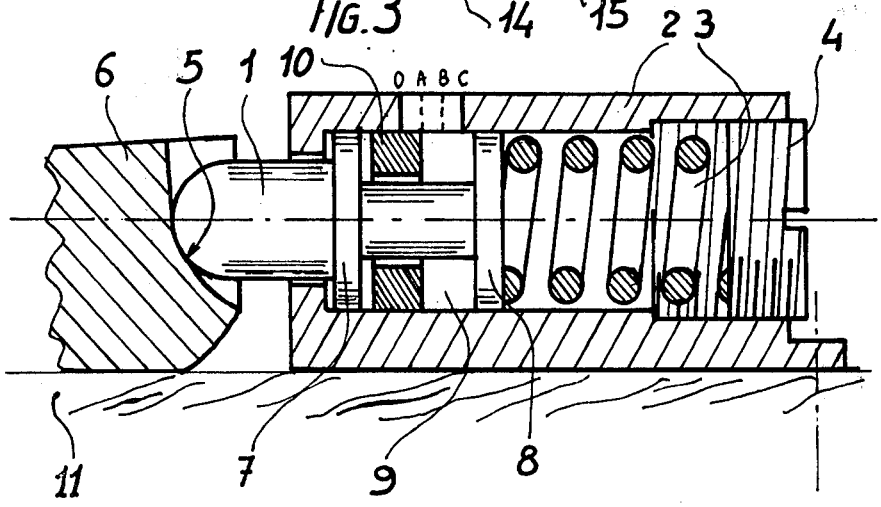
FIG. 3 is a sectional view similar to that of FIG. 1 showing the display ring moved into a position corresponding to the maximum stress recorded.
Figure 4:
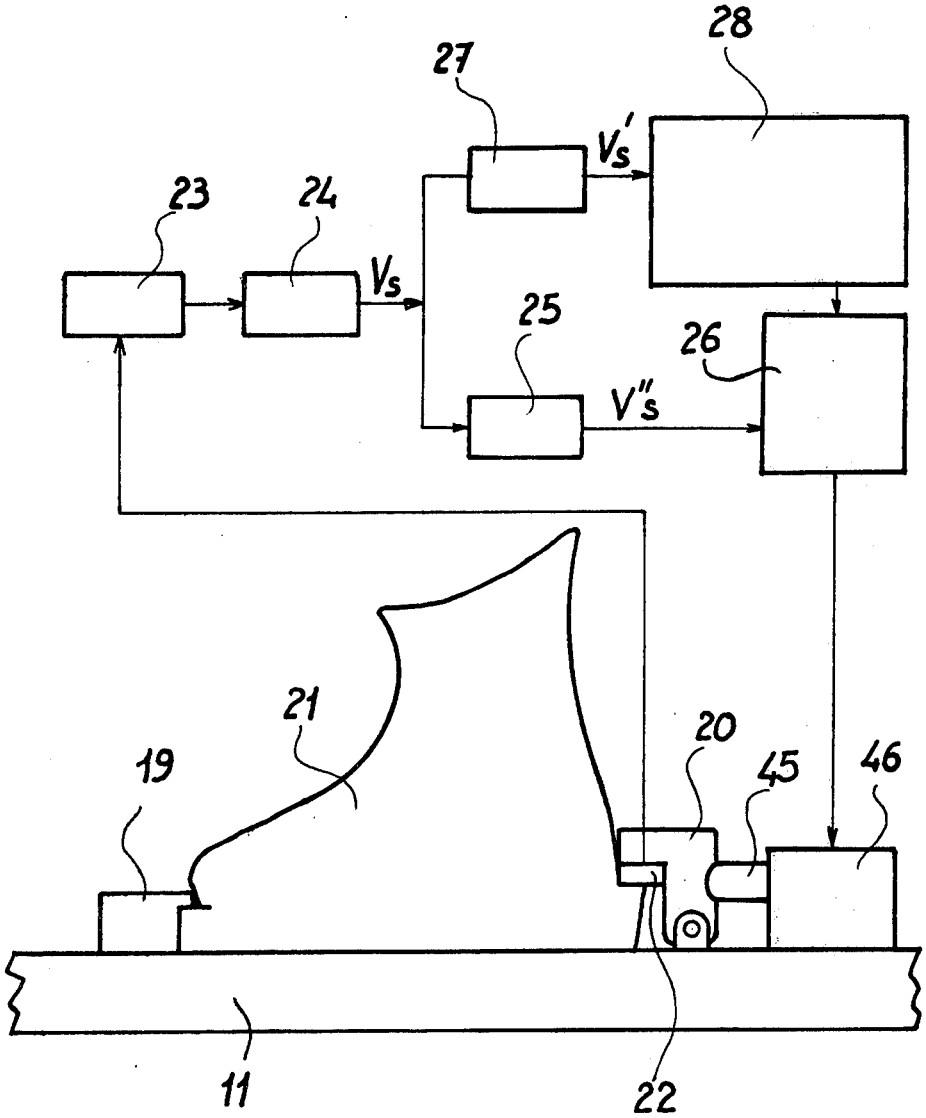
FIG. 4 is a synoptic diagram of an electronic embodiment of the invention adapted to a binding whose release is controlled by an electrical or electronic system.

At the time of a vertical stress for example, the rear part of the plate 6 is raised, which forces the piston 1 to move back. At the time of its movement, the latter pushes the ring 10 rearward by means of the cylindrical collar 7. When the stress ceases and if there has been no release, the piston returns to its locking position which is that shown in FIG. 1. On the other hand, the ring 10 remains in the position into which it has been pushed by the piston, which is that shown in FIG. 3. The longitudinal position of the ring 10 thus indicates, at any instant, the value of the maximum stress on the binding. It is thus possible to deduce from this position, information relating to the adjustment of the binding.

In order to be able to observe the position which the display ring 10 occupies, it is possible to provide a window 13 in the body 2, which window is located at the point where the display ring 10 moves. This window may be divided, by a graduation marked by the points O, A, B, C, into three areas, namely an area OA in which the adjustment of the binding is too strong, an intermediate area AB in which the adjustment of the binding is correct and a third area BC in which the adjustment of the binding is too weak. The point O constituting the zero point is located for example at the beginning of the window 13.

Consequently, if during skiing, the ring 10 occupies a position such that its right-hand edge appears in the window 13, in the area OA showing that the adjustment is too strong, it is necessary to reduce the adjustment, i.e. to reduce the tension of the spring 3 by unscrewing the adjusting plug 4. If the right-hand edge of the ring 10 is located in the areas AB, the adjustment is correct. Finally, if, on the other hand, this right-hand edge appears in the third area BC, the adjustment is too weak, one thus runs the risk of premature release and it is necessary to increase the adjustment by screwing the plug 4.

The point C which may constitute the other end of the window 13, corresponds to a position of the piston 1 in which the release takes place. It should be noted that the construction according to the invention proposes a binding that releases in all directions in which the compression of the spring for lateral release is substantially the same as for a vertical release. If it were a question of different compressions, two locking devices would be provided each with their display ring.

Figure 2:
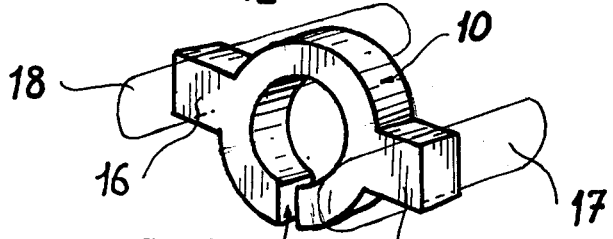
FIG. 2 is a perspective view of the display ring used in the safety binding of FIG. 1.

FIG. 2 shows a non-limiting embodiment of the display ring 10, in a detailed manner. This ring is in the general shape of a circular ring having a radial slot 14 provided for mounting and gives to the outer part of the ring a certain elasticity, enabling the latter to be fitted with friction in the cylindrical bore 12 of the body 2. The ring is provided with diametrically opposed lateral lugs 15 and 16 which pass through the body 2 laterally by virtue of two longitudinal apertures 17 and 18 provided in this body. These two lugs project laterally from the body 2, which makes it possible, after fitting the ski, to replace the display ring 10 against the piston 7.

Variations of the invention will now be described. With reference to FIGS. 4 to 8, these embodiments make it possible to provide for an automatic alteration of the adjustment of the binding depending on actual stresses due to skiing. These embodiments of the invention are electronic and facilitate alteration of the threshold of adjustment of a binding whose release is controlled by an electronic or electrical circuit.

A binding of this type comprises, for example, a front retaining member 19 and a rear retaining member 20 for a boot 21 mounted on a ski 11 and a member 45 for locking the retaining member 20. This locking member itself being controlled by an electrical release circuit 46. The safety binding according to the invention also comprises an electrical circuit ensuring the detection of stresses and the processing of electrical signals depending on the stresses, in order to control the electrical release circuit 46 in an appropriate manner.

The general electrical control circuit comprises means 22 for detecting stresses exerted by the boot 21. These means may be constituted by one or more pick-ups located at appropriate points, in order to record the forces exerted. These detection means are connected to an amplifier 23 for the signal emitted by the means 22 which is a function of the amplitude of the stresses. The output of this amplifier is connected to a rectifier 24 whose output, at which an electrical signal $V_s$ corresponding to the amplitude of the stress appears, is connected firstly to a calculation circuit 25 processing this signal and transmitting an output signal $V''_s$ to a circuit 26 having a comparison threshold and on the other hand, to a circuit 28 for controlling the adjustment threshold, either directly, or through an additional circuit 27 supplying a signal $V'_S$ not representing the value of the stress directly, but a predetermined representative value such as an integration, sum etc. at its output.

Figure 5:
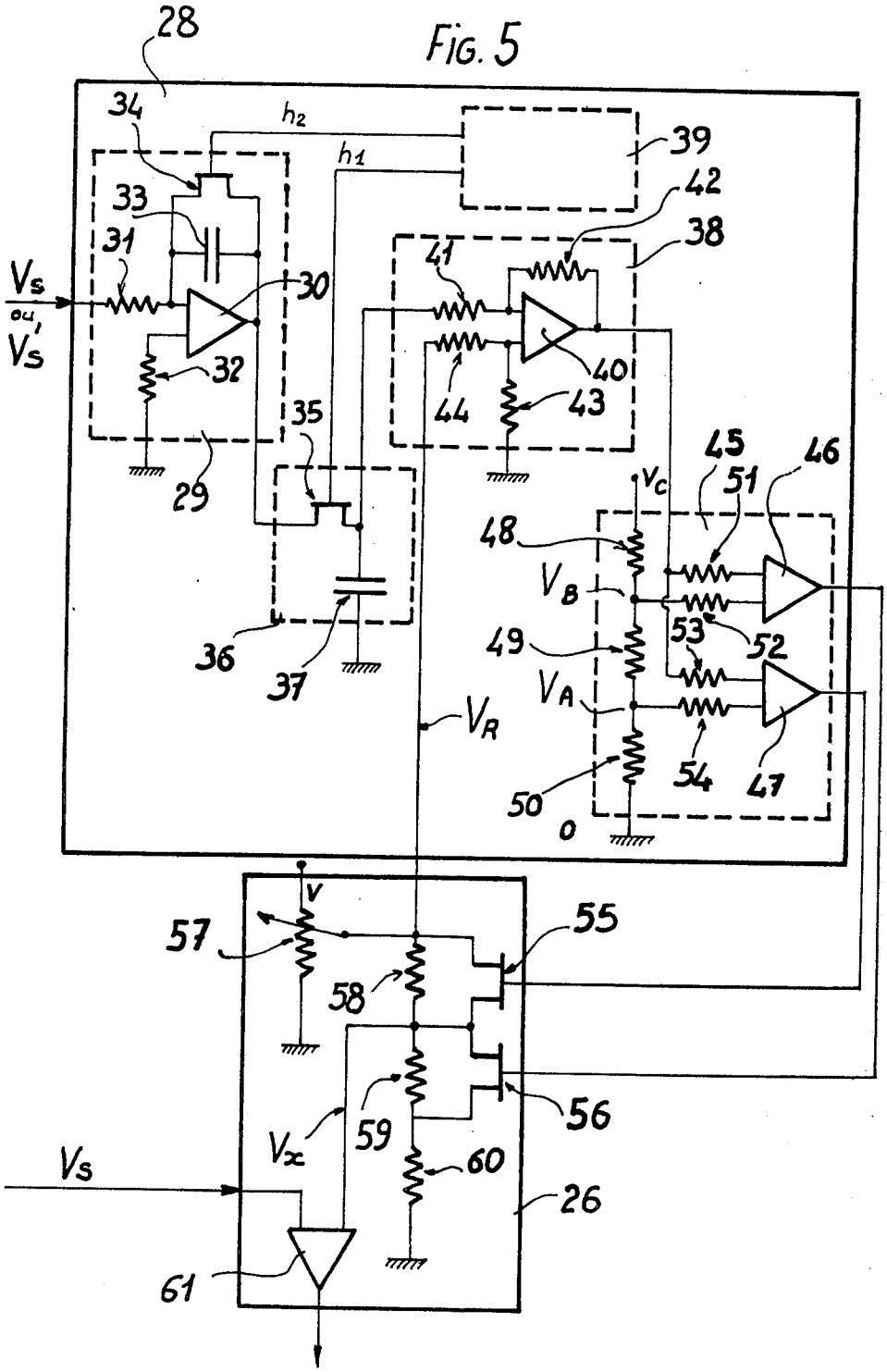
FIG. 5 is a partial circuit diagram of a first embodiment of the circuit of FIG. 4.

A first embodiment of a safety binding according to the invention, controlled electrically or electronically, will now be described with particular reference to FIGS. 5 and 6.

The electrical signal depending on the stress ($V_S$ or $V'_S$) is applied to one input of the circuit 28 for controlling the adjustment threshold and more particularly to one input of an integrator stage 29 comprising an amplifier 30. In fact, the stress signal $V_S$ or $V'_S$ is sent to one input of the amplfier 30, through the intermediary of a resistor 31, the second input of this amplifier 30 being connected to earth by a resistor 32. A capacitor 33 and field effect transistor 34 are connected in parallel between the first input and the output of the amplifier 30.

The output of the amplifier 30 is connected to the input of a field effect transistor 35 forming part of a memory stage 36. The output of this field effect transistor 35 is connected on the one hand to a capacitor 37 which is grounded and on the other hand to one input of a comparison circuit 38.

The gates of the two field effect transistors 34 and 35 are connected respectively to two outputs of a clock 39 which periodically supply two signals of short duration at staggered times, namely a first signal $h_1$ sent to the transistor 35, followed shortly afterwards by a second signal $h_2$ sent to the transistor 34.

The comparison circuit 38 comprises an operational amplifier 40, whereof a first input is connected to the output of the memory stage 36, through the intermediary of a resistor 41, as well as to the output of the amplifier 40 by a resistor 42. The second input of the operational amplifier 40 is connected on the one hand to earth by a resistor 43 and on the other hand to an output of the comparison threshold circuit 26 by a resistor 44. A voltage $V_R$ appears at this output, which voltage depends on the adjustment, as will be seen hereafter.

The output of the comparison circuit 38 is connected to the input of a threshold circuit 45 which comprises two comparison amplifiers 46 and 47 and a voltage divider comprising three resistors 48, 49, 50 connected in series between a voltage pole $V_C$ and earth. Voltages $V_B$ and $V_A$ exist at the junction points between the resistors 48 and 49 on the one hand and 49 and 50 on the other hand, which voltages define therebetween a range corresponding to correct adjustment of the binding, like the area AB in the case of the embodiment of FIGS. 1 and 3.

The amplifier 46 comprises a first input connected by a resistor 51 to the output of the comparison circuit 38 and a second input connected by a resistor 52 to the junction point between the resistors 48 and 49 where the voltage $V_B$ appears. Likewise, the amplifier 47 comprises a first input connected by a resistor 53 to the output of the comparison circuit 38 and a second input connected by a resistor 54 to the junction point between the resistors 49 and 50 where the voltage $V_A$ appears.

The outputs of the amplifiers 46 and 47 of the threshold circuit 45 are respectively connected to the gates of two field effect transistors 55 and 56, forming part of the comparison threshold circuit 26. This circuit also comprises an adjustable potentiometer 57 (pre-adjustment necessary for the adjustment of the binding), whose slide is connected to a voltage divider comprising three resistors 58, 59 and 60 in series. The field effect transistors 55 and 56 are respectively connected in shunt to the resistors 58 and 59. The junction point between the slide of the potentiometer 57 and the resistor 58 is connected to the second input of the amplifier 40 of the comparison circuit 38 and the adjustment voltage $V_R$ is present at this point.

The comparison threshold circuit 26 also comprises an amplifier 61 whereof one input receives the signal $V''_s$, processed by the circuit 25, which signal corresponds to the value of the stress. The other input is connected to the junction point between the resistors 58 and 59 and carries a voltage $V_x$ defining a threshold beyond which the binding should be released.

The operation of the embodiment illustrated in FIG. 5 will now be described with particular reference to the diagram of FIG. 6 and taking into consideration that the circuit 27 has been removed. The circuit 28 thus receives $V_s$ directly. The same is true for FIG. 8. Line a shows the wave shape of the signal representative of the stress $V_s$, line b shows the periodic signals $h_1$, $h_2$, produced by the clock 39, line c shows the output signal of the integrator stage 29 and line d the output signal of the memory stage 36. The stress signal $V_S$, applied to the input of the circuit 28, has an amplitude varying over a period of time depending on the intensity of the stress detected by the means 22. This signal is integrated in the integrator stage 29 whose output voltage has the appearance of the diagram on line c of FIG. 6. The left-hand part of the diagram of FIG. 6 shows, over a period of time O-$t_1$, the case where the intensity of the stress is relatively low. The instant $t_1$ corresponds to the instant when the first signal $h_1$ is emitted by the clock 39. The voltage $V_S$ applied to the input of the integrator stage 29 is translated by the appearance at the output of the latter, at the instant $t_1$ of a voltage $V_1$. At the instant $t_1$, the signal $h_1$ causes the field effect transistor 35 to conduct, which has the effect of causing a voltage signal of amplitude $V_1$ to appear at the output of the memory stage 36, i.e. at the terminals of the capacitor 37, as can be seen on line d of FIG. 6.

At the instant $t_2$, which follows the instant $t_1$ and which is very close to the latter, the second signal $h_2$ appears, emitted by the clock 39. This signal which is applied to the gate of the field effect transistor 34, causes the integrator stage 29 to be re-set to zero, which stage is thus ready for a new integration operation. The diagram on line c of FIG. 6 shows that the output voltage of the integrator stage 29 once more drops to zero shortly after the instant $t_2$.

The voltage signal $V_1$ which appears at the output of the memory stage 36 and which is representative of the level of the stress, is compared, in the comparison circuit 38, with the voltage signal $V_R$ which is a function of the adjustment of the binding. The level of this signal is pre-adjusted by altering the potentiometer 57 forming part of the voltage divider of the comparison threshold circuit 26.

At its output, the operational amplifier 40 of the comparison circuit 38 thus supplies a differential signal which corresponds to the difference between the voltage signal $V_1$ representative of the stress and the voltage signal $V_R$, depending on the adjustment. This differential signal is represented by $V'_1$ on the diagram of line d in FIG. 6.

In the threshold circuit 45, the differential signal $V'_1$ is compared with the two predetermined voltage thresholds $V_A$, $V_B$ which define therebetween the section corresponding to correct adjustment.

Figure 6:
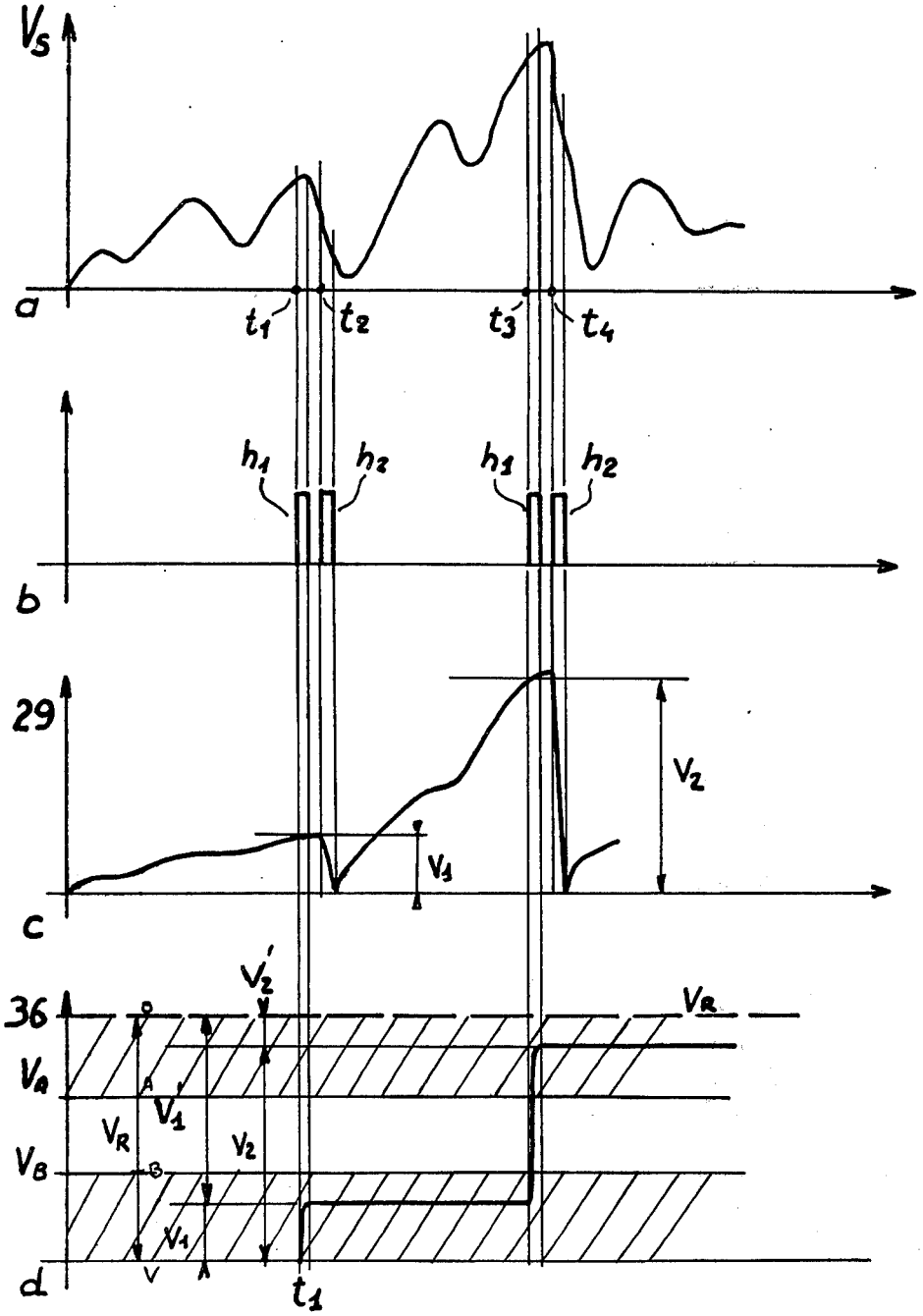
FIG. 6 shows diagrams illustrating the wave shapes of signals appearing at various points of the circuit illustrated in FIG. 5.

It will be assumed, as illustrated in the diagram d of FIG. 6, that the differential signal $V'_1$ is too great, which means that the adjustment is too high with respect to the stress. In this case, the amplifier 46 detects that the threshold corresponding to the voltage $V_B$ is exceeded and emits an output signal which causes closure of the transistor 56. Due to this, the resistor 59 is short-circuited, which causes a drop in the voltage level $V_x$ determining the threshold of releasing the binding. One thus obtains an automatic reduction in the level of adjustment of the binding.

The following part of the diagram of FIG. 6 illustrates the case where the stress and consequently the signal $V_S$ have an amplitude which is much higher than in the preceding case. This is illustrated in the interval $t_2$–$t_3$. As previously, at the instant $t_3$, a signal $h_1$ ensures the transfer of the voltage level $V_2$, present at the output of the integrator stage 29, to the memory stage 36. The integrator stage 29 is re-set to zero as previously, at the instant $t_4$, by the signal $h_2$.

Under these conditions, a voltage signal $V_2$ whose amplitude is clearly higher than $V_1$ appears at the output of the memory stage 36. This voltage $V_2$ is compared yet again, in the comparison circuit 38, with the adjustment voltage $V_R$ and in this case, the operational amplifier 40 supplies a relatively low differential signal $V'_2$ at its output. This signal $V'_2$ is comprised between the level O and the level $V_A$ of the threshold circuit 45, which signifies that the adjustment of the binding is too weak with respect to the stress. The comparison of the differential signal $V'_2$ and the voltage $V_A$ is carried out by the amplifier 47 which supplies a signal causing closure of the transistor 55, at its output. This closure causes short-circuiting of the resistor 58 and consequently, an increase of the voltage $V_x$ corresponding to the release threshold. This is translated by an increase in the adjustment of the binding. In other words, the latter is made harder.

If the differential signal emitted by the comparison circuit 38 is comprised between the level $V_A$ and the level $V_B$, the adjustment is considered as correct and the release threshold $V_x$ is not modified, since none of the transistors 55 and 56 is brought into a conducting state.

Figure 7:
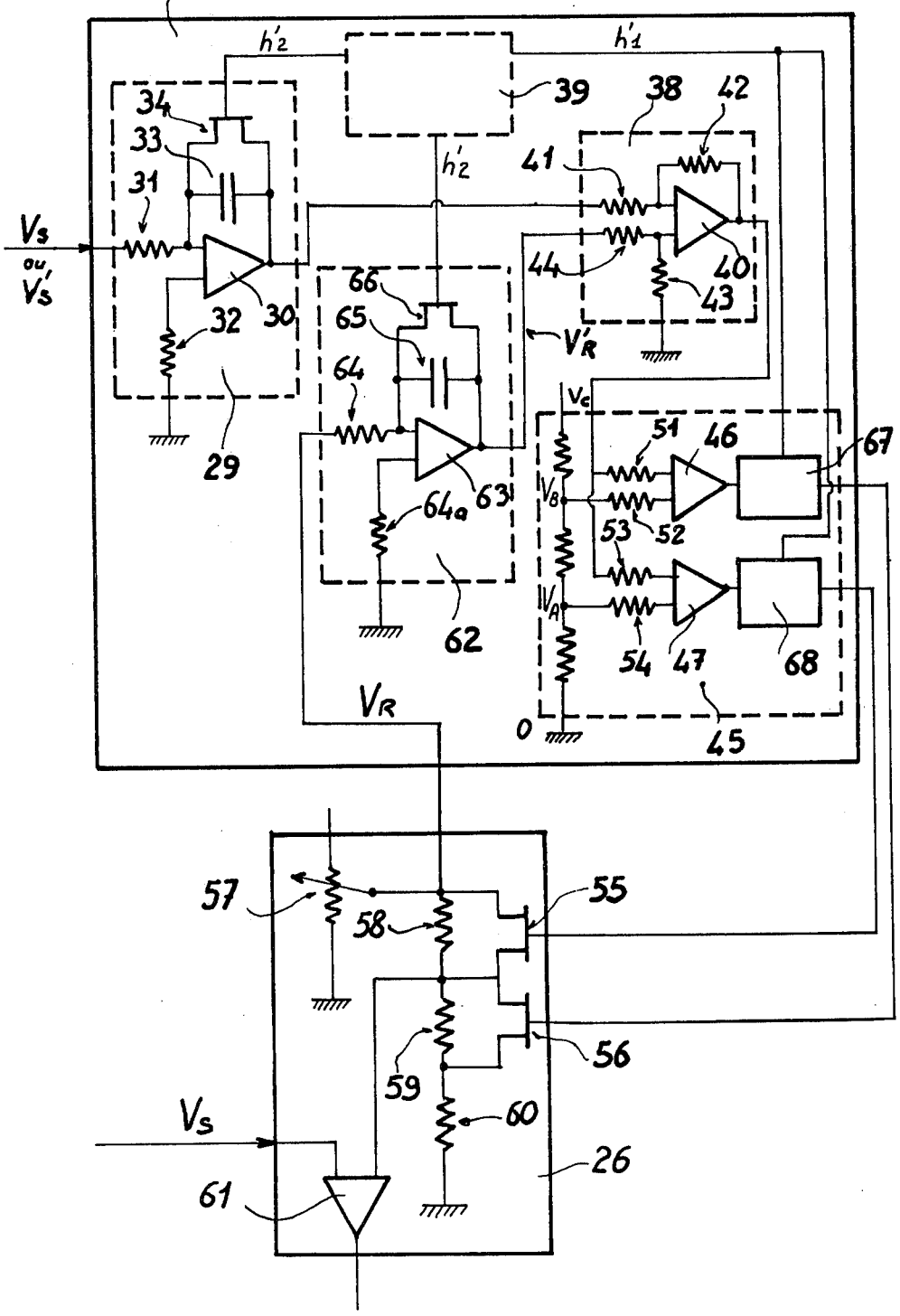
FIG. 7 is a partial circuit diagram of a variation of the circuit of FIG. 4.
Figure 8:
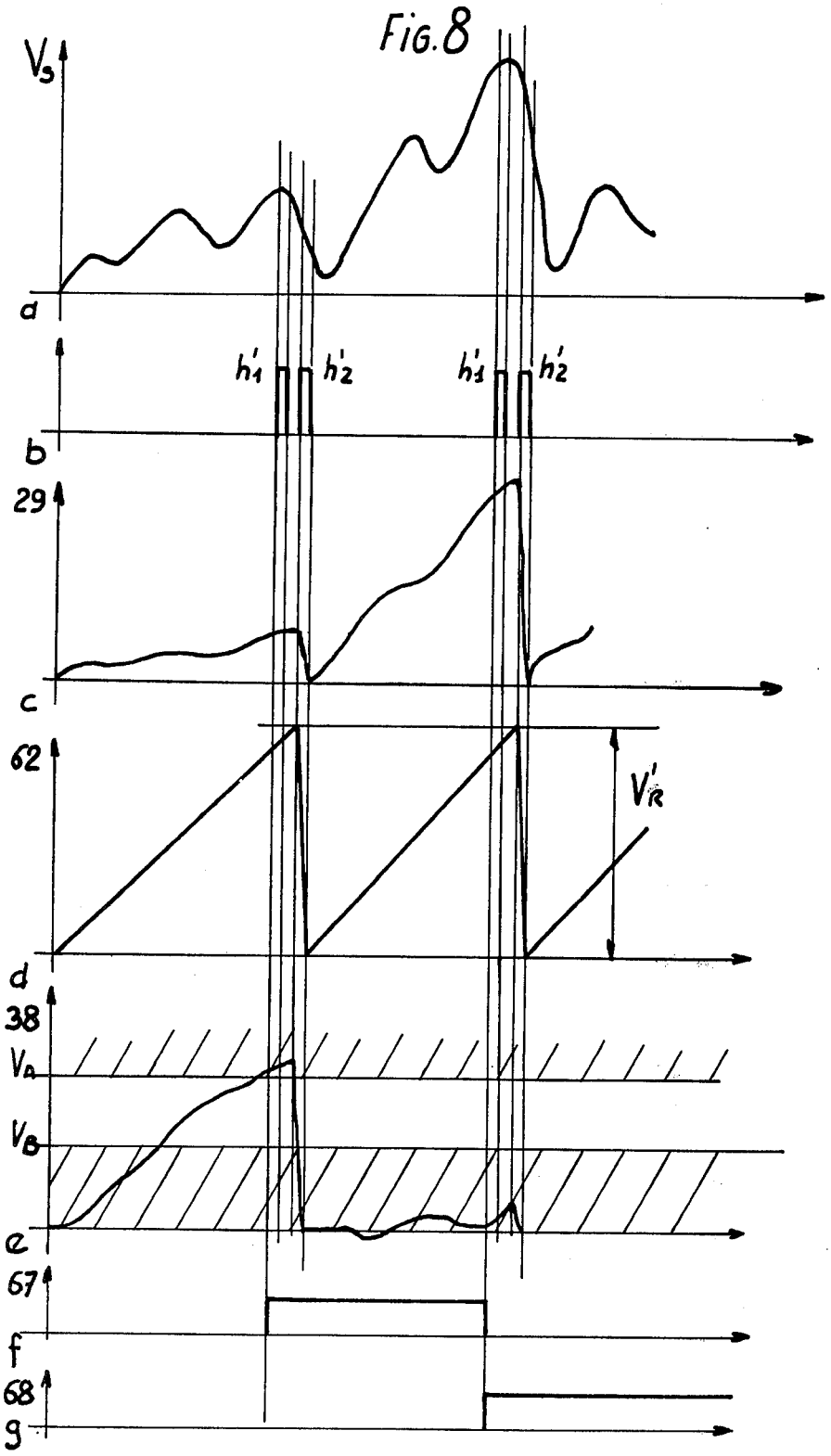
FIG. 8 shows diagrams of the wave shapes of signals appearing at various points of the circuit of FIG. 7.

A variation of the invention will now be described with reference to FIGS. 7 and 8. In this variation, the same constituent parts as those of the embodiment illustrated in FIGS. 5 and 6 are given the same reference numerals.

In this embodiment, the circuit 28 for controlling the adjustment threshold comprises, in addition to the integrator stage 29, a second integrator stage 62 comprising an amplifier 63 whereof one input is connected, by a resistor 64, to the output of the comparison threshold circuit 26, more particularly to the slide of the potentiometer 5 and a second input is connected to earth by a resistor 64*a*. The first input of the amplifier 63 is also connected to its output by a capacitor 65 and a field effect transistor 66, connected in parallel. The gate of this transistor 66 is connected to the clock 39 and receives from the latter a signal $h'_2$ which is in phase with an identical signal applied to the gate of the transistor 34 of the integrator stage 29. In this embodiment, the output of this integrator stage is connected directly to the first input of the comparison circuit 38, i.e. to the resistor 41. Furthermore, the output of the second integrator stage 62 is connected to the other input of the comparison circuit 38, i.e. to the resistor 44.

The embodiment of the invention which is now described also differs from the preceding in that the threshold circuit 45 comprises two bistable devices 67 and 68 connected respectively between the amplifier 46 and the transistor 56 and between the amplifier 47 and the transistor 55. These bistable devices 67 and 68 are also connected to one output of the clock 39 where a series of control pulses $h'_1$ appears.

The operation of the embodiment of the invention which has been described is similar, as regards its main features, to that of the preceding embodiment. At its output, the integrator stage 62 supplies a voltage $V'_R$ which is a function of the adjustment voltage $V_R$ applied to the input of the integrator and which has the appearance of saw teeth. The output voltage of the integrator 62 thus achieves the value $V'_R$ which is a function of $V_R$ and this integrator stage is re-set to zero by each pulse $h'_2$ emitted by the clock 39, at the same time as the other integrator stage 39 which supplies, at its output, a signal such as that illustrated on line c of the diagram of FIG. 8. The comparison circuit 38 permanently compares the output signals of the two integrator stages 29 and 62 and at its output supplies a signal corresponding to the difference of the voltages applied to the input. As previously mentioned, the threshold circuit 45 receives the differential signal and depending on the applitude of this signal, does or does not cause the emission of a control signal at the output of one of the amplifiers 46 and 47. At the time of the appearance of the first control pulse $h'_1$, emitted by the clock 39, this control signal in turn causes the passage of the corresponding bistable device 67 or 68 into the working stage, which causes the closure of the corresponding transistor 55 or 56 of the comparison threshold circuit 26 and the short-circuiting of the resistor 58 or 59 in order to vary the release threshold voltage $V_x$. When the control signal disappears at the output of the amplifier 46 or 47, the following control pulse $h'_1$ causes the corresponding bistable device 67 or 68 to be re-set to zero.

The two bistable devices 67 and 68 thus make it possible to give the command to change the adjustment at a precise moment through the intermediary of the clock 39 and to memorise this command. Line f of the diagrams of FIG. 8 shows the operation of the bistable device 67 and line g shows that of the bistable device 68.

The construction proposed comprise three areas: an area where the adjustment is too strong, an area of correct adjustment and an area where the adjustment is too weak, but this is solely an example and one could equally well provide two areas in addition to the three areas and it is not outside the scope of the invention to provide any number of areas.

The invention applies to all types of bindings, abutments, heel members, bindings comprising plates, boot bindings etc. and to all mechanical and/or electrical bindings. Without diverging from the framework of the invention, it is possible to provide a binding of the electrical type with an indication of the level of stress, re-adjustment taking place manually depending on this information.

What is claimed is:

1. A safety binding for skis, comprising: retaining means; said retaining means being adapted to retain the boot on the ski; a member for locking said retaining means; an electrical circuit for releasing the locking member and an electrical control circuit for detecting the stress exerted during skiing, or values representative of this stress, and transforming the latter into electrical signals and processing these signals for controlling electrical release circuit when the value of the stress detected exceeds a predetermined threshold, the electrical control circuit comprising means for automatically altering the adjustment of the binding depending upon detection of the stress exerted during skiing, said means comprising a circuit for controlling the adjustment threshold in order to vary the value of this threshold automatically, as a function of the level of the signal $V_S$ representing the value of the stress detected or a predetermined representative value of the latter and including; an integrator stage receiving, at its input, the $V_S$ signal and re-set to zero periodically by a signal $h_2$, $h'_2$, emitted by a clock; a comparison circuit with two inputs, one receiving the output signal from the integrator stage depending on the value of the stress detected and the other receiving a voltage $V_R$, $V'_R$, depending on the value of the adjustment threshold in force, a threshold circuit receiving at its input, the output signal of the comparison circuit and defining two voltage thresholds $V_A$ and $V_B$, between which the adjustment of the binding is considered to be correct, the threshold circuit comprising first and second outputs, at which control signals appear respectively when the differential signal emitted by the comparison circuit is too high or too low and the electrical control circuit additionally comprising a circuit having a comparison threshold receiving, at one input, a signal $V_s$ depending on the stress detected and creating an adjustable threshold voltage $V_x$ with which the signal $V_s$ depending on the stress is compared, in order to supply a signal for controlling the electrical release circuit, the circuit having a comparison threshold comprising means respectively connected to the first and second outputs of the threshold circuit to vary the threshold voltage $V_x$ when the value of the differential signal emitted by the comparison circuit is not in the range corresponding to correct adjustment and which is defined by the two voltages $V_A$ and $V_B$.

2. A safety binding according to claim 1, in which the threshold circuit comprises two amplifiers having two inputs and a voltage divider constituted by three resistors in series, the intermediate junction points of these three resistors being supplied with voltages $V_A$ and $V_B$, defining the range of correct adjustment and being connected respectively to the first inputs of the two amplifiers, the second inputs of these two amplifiers being connected in common to the output of the comparison circuit where the differential signal appears, the two outputs of these two amplifiers being connected in parallel to two inputs for controlling the comparison threshold circuit.

3. A safety binding according to claim 1 in which the circuit having a comparison threshold comprises a voltage divider comprising in series, a potentiometer and first, second and third resistors and two transistors respectively connected in parallel to the first and second resistors, terminals for controlling these transistors being respectively connected to the two outputs of the threshold circuit, the junction point between the slide of the potentiometer and the first resistor being connected to the comparison circuit in order to cause the adjustment voltage $V_R$ to appear, the junction point between the first and second resistors being connected to one input of an amplifier, in order to apply the threshold voltage $V_x$ to the latter, the other input of this amplifier receiving the signal $V_s$ depending on the stress, the output of the amplifier being connected to the electrical release circuit.

4. A safety binding according to claim 1, comprising a memory stage connected between the integrator stage and the first input of the comparison circuit, this memory stage being connected to one output of the clock at which a signal $h'_1$ appears periodically, ensuring the transfer of the voltage level reached in the integrator stage to the memory stage and appearing before a signal $h_2$ ensuring that the integrator stage is reset to zero.

5. A safety binding according to claim 1 in which the integrator stage is connected directly to the first input of the comparison circuit and in which a second integrator stage, which is re-set to zero periodically by a signal $h_2$ emitted by the clock, at the same time as the first integrator stage, is connected between the comparison threshold circuit and the second input of the comparison circuit.

6. A safety binding according to claim 5, in which the threshold circuit comprises two bistable devices connected respectively to the outputs of two amplifiers and controlled by signals $h'_1$ emitted by the clock slightly before the signals $h'_2$ ensuring that the integrator stages are re-set to zero, the outputs of the two bistable devices constituting the two outputs of the threshold circuit.

* * * * *